US010395869B2

(12) United States Patent
Tonet

(10) Patent No.: US 10,395,869 B2
(45) Date of Patent: Aug. 27, 2019

(54) RELAY CIRCUIT AND METHOD FOR PERFORMING SELF-TEST OF RELAY CIRCUIT

(71) Applicant: Schneider Electric Industries SAS, Rueil-Malmaison (FR)

(72) Inventor: Richard Tonet, Le Rouret (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 210 days.

(21) Appl. No.: 15/400,405

(22) Filed: Jan. 6, 2017

(65) Prior Publication Data

US 2017/0207051 A1 Jul. 20, 2017

(30) Foreign Application Priority Data

Jan. 20, 2016 (EP) ..... 16305051

(51) Int. Cl.
*H01H 47/22* (2006.01)
*H01H 50/64* (2006.01)
*H01H 47/00* (2006.01)

(52) U.S. Cl.
CPC ..... *H01H 47/22* (2013.01); *H01H 47/002* (2013.01); *H01H 47/004* (2013.01); *H01H 47/005* (2013.01); *H01H 50/64* (2013.01)

(58) Field of Classification Search
USPC ..... 361/139, 160
See application file for complete search history.

(56) References Cited

U.S. PATENT DOCUMENTS 3,579,048 A * 5/1971 Auffret ..... H01H 47/004 361/189
4,762,663 A 8/1988 Cook et al.
(Continued)

FOREIGN PATENT DOCUMENTS

CN 101578678 A 11/2009
CN 102306592 A 1/2012
(Continued)

OTHER PUBLICATIONS

English translation of Chinese Office Action dated Jul. 2, 2018 in Chinese Patent Application No. 201710045813.6.
(Continued)

*Primary Examiner* — Danny Nguyen
(74) *Attorney, Agent, or Firm* — Oblon, McClelland, Maier & Neustadt, L.L.P.

(57) ABSTRACT

A relay circuit and a method for performing a self-test. The relay circuit has four relays, each relay having a first forcibly guided contact and a second forcibly guided contact. The four relays are arranged in a first and a second pair of two in series connected first forcibly guided contacts. The first and second relay pair are arranged in parallel between a power supply connection and a load connection for switching a power supply to a load through the first forcibly guided contacts. Such a relay circuit enables supplying power via one of the relay pairs, while cutting power via the other relay pair, which facilitates testing of the relay pair which has cut power without interrupting the process supervised by the Safety Instrumented System which the relay circuit forms part of.

14 Claims, 2 Drawing Sheets

(56) References Cited

U.S. PATENT DOCUMENTS

| | | | | |
|---|---|---|---|---|
| 2002/0011888 | A1 | 1/2002 | Behrens | |
| 2007/0008669 | A1 | 1/2007 | Al-Haddad | |
| 2008/0067876 | A1* | 3/2008 | Nitsche ..... | H01H 47/002<br>307/326 |
| 2009/0251835 | A1 | 10/2009 | Meinherz | |

FOREIGN PATENT DOCUMENTS

| | | | |
|---|---|---|---|
| CN | 104597750 | A | 5/2015 |
| DE | 199 15 234 | A1 | 10/2000 |
| DE | 10 2006 053 397 | A1 | 5/2008 |
| EP | 0 241 270 | A1 | 10/1987 |
| EP | 1 529 707 | A2 | 5/2005 |
| EP | 1 742 339 | A2 | 1/2007 |
| EP | 2 416 339 | A2 | 2/2012 |
| WO | WO 01/35432 | A1 | 5/2001 |

OTHER PUBLICATIONS

Chinese Office Action dated Mar. 14, 2019 in Chinese Patent Application No. 201710045813.6 with translation.

* cited by examiner

RELAY CIRCUIT AND METHOD FOR PERFORMING SELF-TEST OF RELAY CIRCUIT

The present invention relates to a relay circuit, and more particular to a safety relay circuit arranged to perform a self-test and a method for performing a self-test.

BACKGROUND

In industrial processes multiple machines are used to perform automated tasks. These processes are commonly controlled and supervised through programmable logic controllers (PLC) or other pieces of automation equipment capable of controlling and driving machines. In case of malfunction, process disruption or other incidents posing hazardous risks to personnel or other machines, the controller needs to intervene in the process. For example by cutting the power supply to a machine or changing the mode of operation of a machine into safe mode. In short, the control circuit enables to switch into a fail safe state.

This requires the presence of actuators, sensors and/or other equipment to implement a safety function. Safety functions are applied in all those applications where system malfunctions have a decisive effect on the safety of personnel, the environment and equipment concerned. Such a safety function may be assessed by its' level of integrity: the Safety Integrity Level (SIL). This reflects the ability of the system to reduce risks to a tolerable level.

The design of a Safety Instrumented System is subject to the international standard IEC 61508 for "Functional Safety of Electrical/Electronic/Programmable Electronic Safety-Related Systems" as developed by the International Electrotechnical Commission (IEC). This standard specifies both the risk assessment and the measures to be taken in the design of safety functions consisting of sensor, logic solver and actuator. Such measures include "fault avoidance" (systematic faults) and "fault control" (systematic and random faults). It provides a design standard for Safety Instrumented Systems to reduce the risk to a tolerable level.

One class of switching equipment concerns safety relays, of which the design requirements are defined in Standard EN 50205 "Relays with forcibly guided contacts". Safety relays with forcibly guided contacts play a decisive role in avoiding accidents on machines and in systems. Forcibly guided contacts monitor the function of the safety control circuits. For this safety function, all the assumed faults that can occur must already have been taken into consideration and their effects examined.

Relays with forcibly guided contacts have at least two contacts that provide opposite connective states, while one is "open" the other may be closed. Such safety relays have the characteristic that make and break contacts can never both be closed at the same instance. In particular, power relays with at least one break contact and at least one make contact are designed that by mechanical means make and break contacts can never be simultaneously in the closed position. This requires that contact gaps may never be less than 0.5 mm over the operating life, not only under normal operating conditions, but also when a fault occurs. This requirement allows the respective exclusive-or contact to detect the fault of a contact to open.

For example, the malfunction of a make contact is indicated by the non-opening of the break contact when the energization is switched on.

Or vice versa, the malfunction of a break contact is indicated by the non-closing of the make contact when the energization is switched on.

Safety relays with forcibly guided contacts as described above are energized only in case a safety issue is detected, under normal operating conditions the relays are in de-energized mode. Hence, a process not encountering any safety issues during long periods of uptime, does not energize any of the relays. Accordingly, over time uncertainty may arise about the reliability of the relays in case of emergency, as a relay failure will not be detected until energization of the contacts. For example, the contact may have become welded or the contact spring has broken. In order to check the operation of the relay and the reliability of the safety circuit, preventive periodical verifications need to be performed. These interventions require a shutdown of the system or process under investigation, which resulting downtime poses a main disadvantage.

SUMMARY OF INVENTION

It is an object of the invention to provide a relay circuit for safety applications that alleviates the above mentioned drawback. The relay circuit may be applied in a safety circuit able to comply with Safety Integrity Level 3.

According to a first aspect, a relay circuit is provided that includes four relays, each relay having a first forcibly guided contact and a second forcibly guided contact. The four relays are arranged in a first and a second pair of two in series connected first forcibly guided contacts. The first and second relay pair are arranged in parallel between a power supply connection and a load connection for switching a power supply to a load through the first forcibly guided contacts. Such a relay circuit enables supplying power via one of the relay pairs, while cutting power via the other relay pair, which facilitates testing of the relay pair which has cut power without interrupting the process supervised by the Safety Instrumented System which the relay circuit forms part of.

According to a further aspect, the relay circuit further includes a microcontroller. the microcontroller is arranged for operating the first relay pair to supply power to the load through the first forcibly guided contacts of the first relay pair, operating the second relay pair to cut power to the load through the first forcibly guided contacts of the second relay pair, and verifying each of the relays of the second relay pair separately.

In one embodiment, the first forcibly guided contact of each relay is a normally open forcibly guided contact and the second forcibly guided contact of each relay is a normally closed forcibly guided contact.

In another embodiment, the first forcibly guided contact of each relay is a normally closed forcibly guided contact and the second forcibly guided contact of each relay is a normally open forcibly guided contact In a further aspect, a method is disclosed for performing a self test of the relay circuit as disclosed. The method may be repeated periodically at distinct intervals of time, uptime or production output. This facilitates self test monitoring, which may be performed as an automated process.

BRIEF DESCRIPTION OF THE DRAWINGS

By way of example only, the embodiments of the present disclosure will be described with reference to the accompanying drawing, wherein.

DETAILED DESCRIPTION

Figure 1:
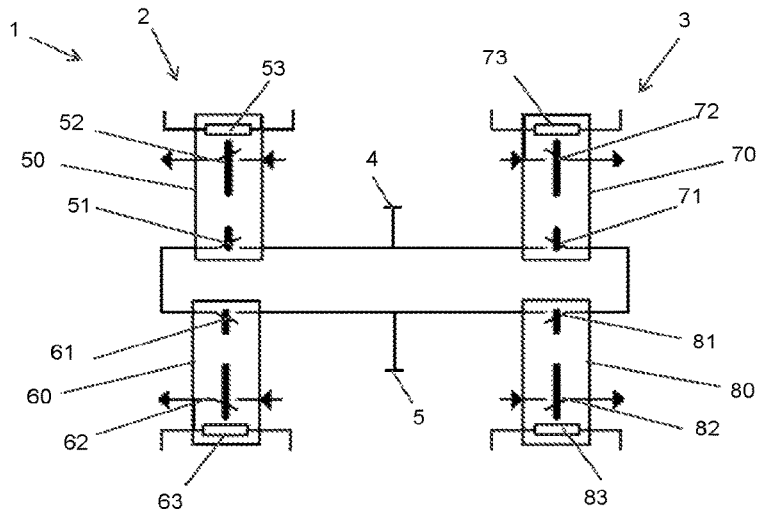
FIG. 1 illustrates schematically an example of a relay circuit in accordance with the invention.

Referring to FIG. 1, a relay circuit 1 is shown having four relays 50, 60, 70, 80. Each relay has a first forcibly guided contact 51; 61, 71, 81 and a second forcibly guided contact 52, 62, 72; 82. The four relays 50, 60, 70, 80 are arranged in a first pair 2 and a second pair 3 of two in series connected first forcibly guided contacts 51, 61; and 71, 81. Thus, two relays 50, 60 form a first pair 2 of two relays. And two relays 70, 80 form a second pair 3 of two relays. The first relay pair 2 has the first forcibly guided contacts 51, 61 connected in series. The second relay pair 3 has the first forcibly guided contacts 71, 81 connected in series. The first and second relay pair 2, 3 are arranged in parallel between a power supply connection 4 and a load connection 5 for switching a power supply to a load through the first forcibly guided contacts 51, 61; and 71, 81. Hence, each relay pair 2, 3 forms a branch of a parallel network for connecting the power supply to the load.

In this example, the relays 50, 60, 70, 80 are switched by energizing a coil 53, 63, 73, 83 which pulls the first forcibly guided contact 51; 61, 71, 81 and the second forcibly guided contact 52, 62, 72; 82 from one state to another state. So, switched from open to close or from close to open. Forcibly guided contacts are characterized by the state they are in when not energized i.e. de-energized, which is referred to respectively as 'normally open' or 'normally closed'.

In the relay circuit 1, the first forcibly guided contacts 51; 61, 71, 81 and the second forcibly guided contacts 52, 62, 72; 82 are preferably of the opposite type. For example, in the relay circuit 1 of FIG. 1, the first forcibly guided contact 51; 61, 71, 81 of each relay is a normally open forcibly guided contact and the second forcibly guided contact 52, 62, 72; 82 of each relay is a normally closed forcibly guided contact. In other embodiments, for example, the first forcibly guided contact 51; 61, 71, 81 of each relay may be of the normally closed type and the second forcibly guided contact 52, 62, 72; 82 of each relay may be the normally open type.

As the first forcibly guided contacts 51; 61 and 71, 81 of each relay pair 2, 3 are of the same type, the power supply connection 4 and the load connection 5 may be electrically connected through these first contacts. The relay pairs 2, 3 may be operated independently, so the first and second relay 50, 60 of the first relay pair 2 may be energized, while the first and second relay 70, 80 of the second relay pair 3 may be de-energized. Each relay pair provides functionality that complies with System Integrity Level 3 (SIL3), as a command will activate two series connected switches.

Figure 2:
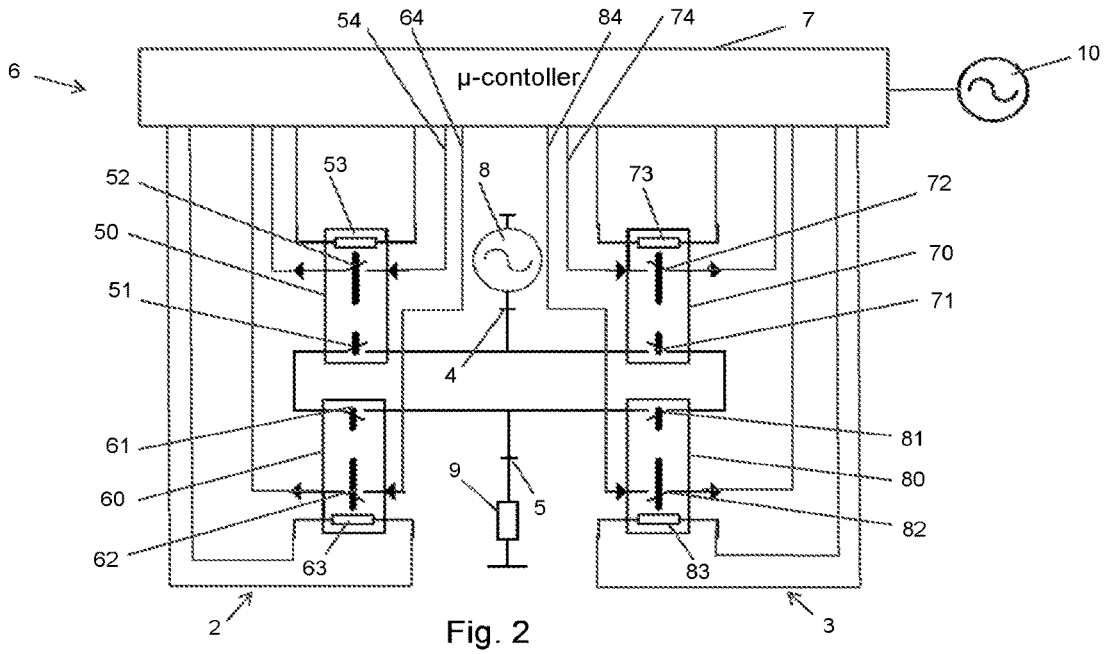
FIG. 2 illustrates schematically an example of a safety circuit in accordance with the invention.

Referring to FIG. 2, a safety circuit 6 is shown including the relay circuit 1 of FIG. 1, a power supply 8 connected to the power supply connection 4 of the relay circuit 1 and a load 9 connected to the load connection 5. The relay circuit 1 further includes a microcontroller 7 and a circuit power supply 10. The circuit power supply 10 is controlled by the microcontroller 7 to supply power for operating the first relay 2 pair and the second relay pair 3. In this example, operating the relay pairs 2, 3 is performed by energizing or de-energizing the coils 53, 63; 73, 83 of each relay 50, 60; 70, 80.

The microcontroller 7 is arranged for operating one relay pair 2, 3 to connect the power supply 8, i.e. to supply power, to the load 9 through the first forcibly guided contacts 51, 61; 71, 81 of that relay pair 2, 3, before operating the other relay pair 3, 2 to disconnect the power supply 8, i.e. to cut power, to the load 9 through the first forcibly guided contacts 71, 81; 51, 61 of the that relay pair 3, 2. The microcontroller 7 is further arranged for verifying the operation of each of the relays 70, 80; 50, 60 of the relay pair 3, 2 through which power is cut.

Hence, power from the power supply 8 to the load 9 will always be provided through one of the relay pars 2, 3. In the examples of FIGS. 1 and 2 with normally open contacts, this means one of the relay pairs 2,3 is energized before the other relay pair 3, 2 is de-energized. In the case of normally closed contacts, this means one of the relay pairs 2,3 is de-energized before the other relay pair 3, 2 is energized. The relay pair through which power is cut may then be tested to verify proper operation of each relay thereof.

As with forcibly guided contacts with one normally open and one normally closed contact the contacts can never be in the same state, the closed state of one contact necessarily indicates the open state of the other contact. Accordingly, commanding the opening of the contact through which power is supplied to the load under normal operation conditions should result in the closing of the other linked contact of that same relay. This operation allows the use of the linked contact to verify whether it has closed and therewith that the contact through which the power was supplied is indeed open.

Accordingly, verifying each of the relays 50, 60; 70, 80 of the relay pair 2, 3 through which power is cut, may in this example include the microcontroller 7 further to be arranged to send a test signal to each second forcibly guided contact of each relay and check the transmission thereof. Thus, the microcontroller 7 is arranged for sending a first feedback signal 74 through the second forcibly guided contact 72 of a first one 70 of the two relays 70, 80 of the relay pair 3 through which power is cut and checking the transmission, i.e. receipt, of the first feedback signal 74. And consecutively sending a second feedback signal 84 through the second forcibly guided contact 82 of a second one 80 of the two relays 70, 80 of the relay pair through which power is cut and checking the transmission i.e. receipt of the second feedback signal 84. Similarly, the microcontroller 7 may send consecutive feedback signals 54, 64 to the second forcibly guided contacts 52, 62 of the relays 50, 60 of the first relay pair 2, when power supply to the load 9 through that relay pair 2 is cut and check the transmission thereof.

If the feedback signal is not received back at the microcontroller 7, this means that the second forcibly guided contact has not closed and that the first forcibly guided contact is still closed. This indicates a malfunction of the relay or the command, either way the SIL3 functionality is defective. If the feedback signal is received, the proper functionality of the relays is verified.

Figure 3:
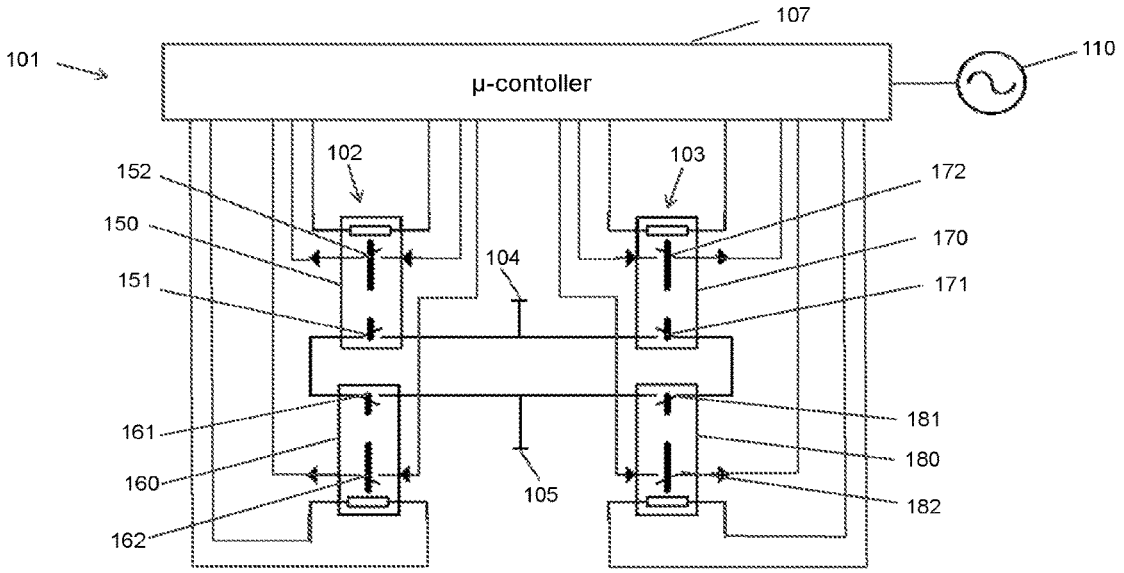
FIG. 3 illustrates another example of a relay circuit in accordance with the invention.

Referring to FIG. 3, another example of a relay circuit 101 is shown. The relay circuit 101 has four relays 150, 160, 170, 180, a micro controller 107, a circuit power supply 110. Each relay 150, 160, 170, 180 has a normally open forcibly guided contact 152, 162, 172, 182 and a normally closed forcibly guided contact 151, 161, 171, 181. The four relays 150, 160, 170, 180 are arranged in a first 102 pair and a second pair 103 of two in series connected normally closed forcibly guided contacts 151, 161, 171, 181. The first 102 and second relay pair 103 are arranged in parallel between a power supply connection 104 and a load connection 105 for switching a power supply to a load through the normally closed forcibly guided contacts 151, 161, 171, 181. Hence, in this example, the first forcibly guided contacts, now normally closed instead of normally open, are not energized during regular operation, but energized in case of a process disruption or hazardous incident; and for testing and verification purposes.

Figure 4:
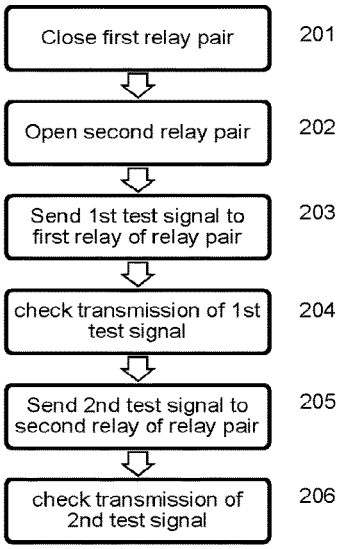
FIG. 4 is a flow diagram illustrating a method in accordance with the invention.

Referring to FIG. 4, a flow diagram is shown illustrating a method for performing a self-test of a relay circuit. A relay circuit as disclosed in FIGS. 1 and 3 is provided, which may be connected to a power supply and a load to form a safety circuit as shown in FIG. 2. However, the self-test may be performed without connection to a power supply and load.

The method further includes operating one relay pair to supply power to the load through that relay pair 201, before operating the other relay pair to cut power to the load through that relay pair. Operating one relay pair to supply power means closing the relays of that relay pair such that an electrical connection is established between the power supply connection and the load connection. Of course, if no power supply is connected, no actual electrical energy is delivered. Similarly, if no load is connected to the load connection, no electrical energy may be delivered to the load. As described above, operating one relay entails energizing or de-energizing the forcibly guided contacts of that relay, depending on the type of contact: normally open or normally closed.

Consecutively, the method includes operating the other relay pair to cut power to the load through that relay pair 202. As power is supplied through one relay, before power supply through the other relay is cut, temporarily power is supplied through both relay pairs in parallel, until power is cut through the other relay. Once power is cut through the relay pair, the functioning of the relays of that rely pair may be tested. Accordingly, the method includes verifying each of the relays of the relay pair through which power is cut.

The verifying of each of the relays of the relay pair through which power is cut includes sending a first feedback signal 203 through the second forcibly guided contact of a first one of the two relays and checking the transmission of the first feedback signal 204. And further includes, sending a second feedback signal 205 through the second forcibly guided contact of a second one of the two relays and checking the transmission of the second feedback signal 206. The verification of each relay may be performed consecutively or simultaneously. Hence, the first feedback signal and the second feedback signal may be sent at distinct moments in time or at the same instance.

The same procedure may be repeated to verify operation of all relays of both relay pairs. Verification may be performed at fixed intervals of time, uptime or production output. This allows self test monitoring, which may be performed as an automated process.

Although the present invention has been described above with reference to specific embodiments, it is not intended to be limited to the specific form set forth herein. Rather, the invention is limited only by the accompanying claims and, other embodiments than the specific above are equally possible within the scope of these appended claims.

Furthermore, although exemplary embodiments have been described above in some exemplary combination of components and/or functions, it should be appreciated that, alternative embodiments may be provided by different combinations of members and/or functions without departing from the scope of the present disclosure. In addition, it is specifically contemplated that a particular feature described, either individually or as part of an embodiment, can be combined with other individually described features, or parts of other embodiments.

The invention claimed is:

1. A relay circuit, comprising:
four relays, each relay comprising:
a first forcibly guided contact, and
a second forcibly guided contact;
wherein the four relays are arranged in a first pair and a second pair of two in series connected via the first forcibly guided contacts, and
wherein the first relay pair and second relay pair are arranged in parallel between a power supply connection and a load connection for switching a power supply to a load through the first forcibly guided contacts.

2. The relay circuit according to claim 1, wherein:
the first forcibly guided contact of each relay is a normally open forcibly guided contact; and
the second forcibly guided contact of each relay is a normally closed forcibly guided contact.

3. The relay circuit according to claim 1, wherein:
the first forcibly guided contact of each relay is a normally closed forcibly guided contact; and
the second forcibly guided contact of each relay is a normally open forcibly guided contact.

4. The relay circuit according to claim 1, further comprising a microcontroller, wherein the microcontroller is arranged for:
operating one relay pair to supply power to the load connection, before operating the other relay pair to cut power to the load connection,
operating the other relay pair to cut power to the load connection, and
verifying each of the relays of the relay pair through which power is cut.

5. The relay circuit according to claim 4, wherein verifying each of the relays of the relay pair through which power is cut comprises the microcontroller being arranged for:
sending a first feedback signal through the second forcibly guided contact of a first one of the two relays of the relay pair through which power is cut;
checking transmission of the first feedback signal;
sending a second feedback signal through the second forcibly guided contact of a second one of the two relays of the relay pair through which power is cut, and
checking transmission of the second feedback signal.

6. The relay circuit according to claim 4, further comprising:
a circuit power supply controlled by the microcontroller to supply power for operating the first relay pair and the second relay pair.

7. A relay circuit, comprising:
four relays, each relay comprising:
a normally open forcibly guided contact, and
a normally closed forcibly guided contact;
wherein the four relays are arranged in a first pair and a second pair of two in series connected via the normally open forcibly guided contacts, and
wherein the first and second relay pair are arranged in parallel between a power supply connection and a load connection for switching a power supply to a load through the normally open forcibly guided contacts.

8. The relay circuit according to claim 7, further comprising a microcontroller, wherein the microcontroller is arranged for:

energizing one relay pair to enable supplying power to the load through that relay pair, before de-energizing the other relay pair to enable cutting power to the load through that relay pair, de-energizing the other relay pair to enable cutting power to the load through that relay pair, and verifying each of the relays of the relay pair through which power is cut.

9. The relay circuit according to claim 8, wherein verifying each of the relays of the relay pair through which power is cut comprises the microcontroller being arranged for:

sending a first feedback signal through the normally closed forcibly guided contact of a first one of the two relays;

checking the transmission of the first feedback signal;

sending a second feedback signal through the normally closed forcibly guided contact of a second one of the two relays, and checking transmission of the second feedback signal.

10. The relay circuit according to claim 8, further comprising:

a circuit power supply controlled by the microcontroller to supply power for energizing the first relay pair and the second relay pair.

11. A relay circuit, comprising:

four relays, each relay comprising:

a normally open forcibly guided contact, and a normally closed forcibly guided contact;

wherein the four relays are arranged in a first pair and a second pair of two in series connected via the normally closed forcibly guided contacts, and wherein the first and second relay pair are arranged in parallel between a power supply connection and a load connection for switching a power supply to a load through the normally closed forcibly guided contacts.

12. A safety circuit, comprising:

the relay circuit according to claim 1;

a power supply connected to the power supply connection; and a load connected to the load connection.

13. A method for performing a self-test of a relay circuit, the relay circuit including four relays, each relay comprising a first forcibly guided contact and a second forcibly guided contact, the four relays being arranged in a first and a second pair of two in series connected via the first forcibly guided contacts, the first and second relay pair arranged in parallel between a power supply connection and a load connection for switching a power supply to a load through the first forcibly guided contacts, the method comprising:

operating one relay pair to supply power to the load through that relay pair, before operating the other relay pair to cut power to the load through that relay pair;

operating the other relay pair to cut power to the load through that relay pair; and verifying each of the relays of the relay pair through which power is cut.

14. The method according to claim 13, wherein verifying each of the relays of the relay pair through which power is cut comprises:

sending a first feedback signal through the second forcibly guided contact of a first one of the two relays;

checking the transmission/receipt of the first feedback signal;

sending a second feedback signal through the second forcibly guided contact of a second one of the two relays, and checking transmission or receipt of the second feedback signal.

* * * * *